US007637123B2

(12) United States Patent
Hashimian et al.

(10) Patent No.: US 7,637,123 B2
(45) Date of Patent: Dec. 29, 2009

(54) HOLLOW METAL JEWELRY RING

(75) Inventors: Ervant Hashimian, Middle Village, NY (US); Garabed Ayvazian, Rego Park, NY (US)

(73) Assignee: Unimold Cast Ltd., New York, NY (US)

( * ) Notice: Subject to any disclaimer, the term of this patent is extended or adjusted under 35 U.S.C. 154(b) by 393 days.

(21) Appl. No.: 11/725,812

(22) Filed: Mar. 20, 2007

(65) Prior Publication Data

US 2008/0229783 A1 Sep. 25, 2008

(51) Int. Cl.
*A44C 9/00* (2006.01)

(52) U.S. Cl. ..... 63/15

(58) Field of Classification Search ..... None
See application file for complete search history.

(56) References Cited

U.S. PATENT DOCUMENTS

| | | | | |
|---|---|---|---|---|
| 158,914 | A * | 1/1875 | Cottle | 72/348 |
| 1,308,894 | A * | 7/1919 | Dinhofer | 63/15 |
| 1,422,819 | A * | 7/1922 | Blaicher | 63/15 |
| 2,128,644 | A * | 8/1938 | Gittler | 63/15 |
| 5,718,278 | A | 2/1998 | Baum | |
| 6,453,699 | B1 | 9/2002 | Hashimian et al. | |
| 6,467,526 | B1 | 10/2002 | Cope | |
| 6,554,052 | B2 | 4/2003 | Hashimian et al. | |
| 6,701,618 | B2 * | 3/2004 | Gefen | 29/896.412 |
| 7,080,678 | B2 | 7/2006 | Hashiman et al. | |

* cited by examiner

*Primary Examiner*—Jack W. Lavinder
(74) *Attorney, Agent, or Firm*—Gottlieb, Rackman & Reisman

(57) ABSTRACT

There is provided a method or process for fabricating a hollow jewelry article which is hollowed or bored out. In accordance with this process, a metal ring model is prepared comprising a solid shank and a metal plate supported along the internal perimeter of the shank by means of a series of spokes extending from the shank. A first metal mold is produced from the metal ring model having the external shape of the jewelry article to be manufactured. From this mold, a wax model of the jewelry article is produced which is first filed down and then cast in order to form a metal model of a core insert; the core insert, like the ring model, has a plate disposed along the perimeter of the shank. This core insert is used to produce a second metal mold. This second mold may then be used repeatedly in order to form a soluble wax core insert model which is then inserted into the cavity of the first mold in order to define the hollow region of the article. A non-soluble wax is then introduced into the first mold for completely surrounding the soluble wax core insert. The non-soluble wax then hardens and the entire unit is removed from the first mold, including the soluble wax core. The core is then removed by a suitable water soluble or chemical mechanism. The remaining wax model contains a hollow core running along a substantial portion of the arcuate length of the shank; the shank has a finger facing surface formed with a plurality of openings which lead to said core. The wax model is then cast in order to form the inventive ring design.

12 Claims, 11 Drawing Sheets

FIG.10
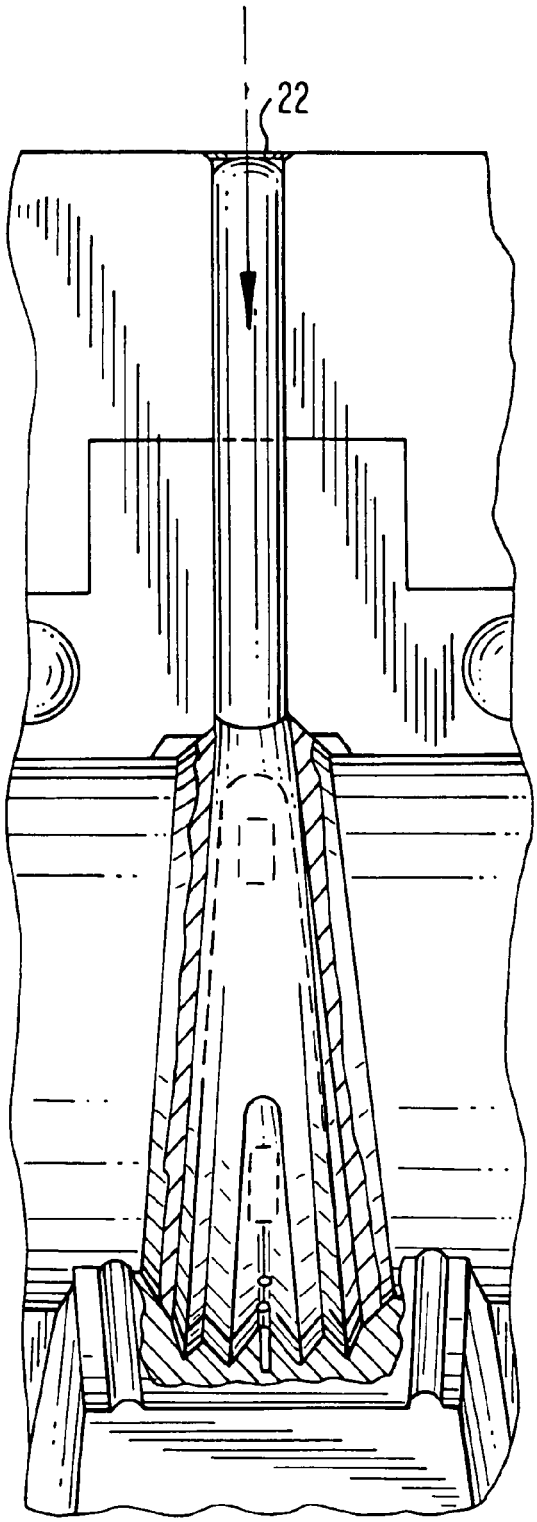
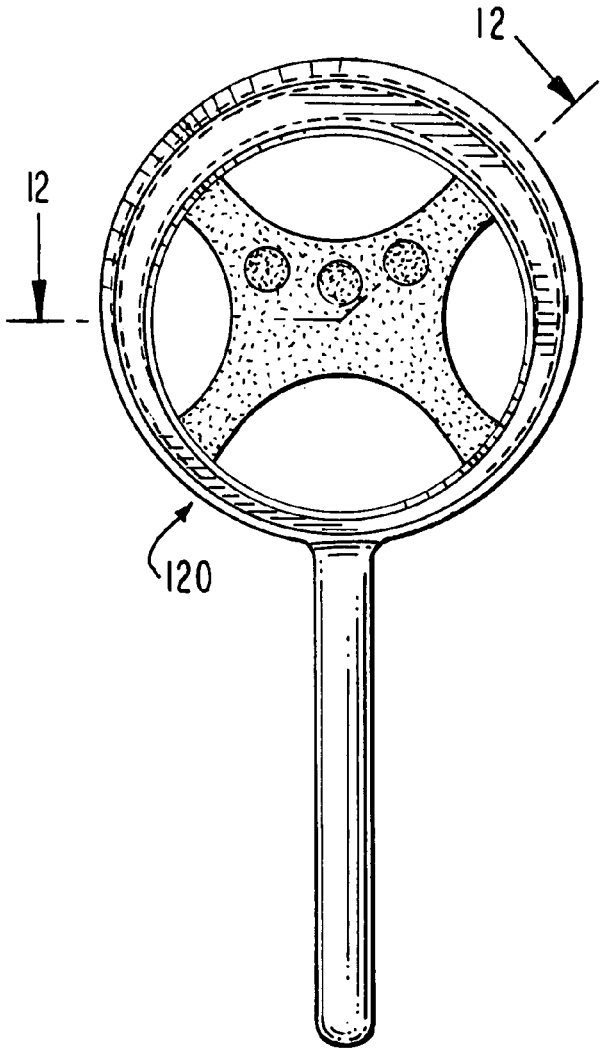
FIG.11

FIG. 12
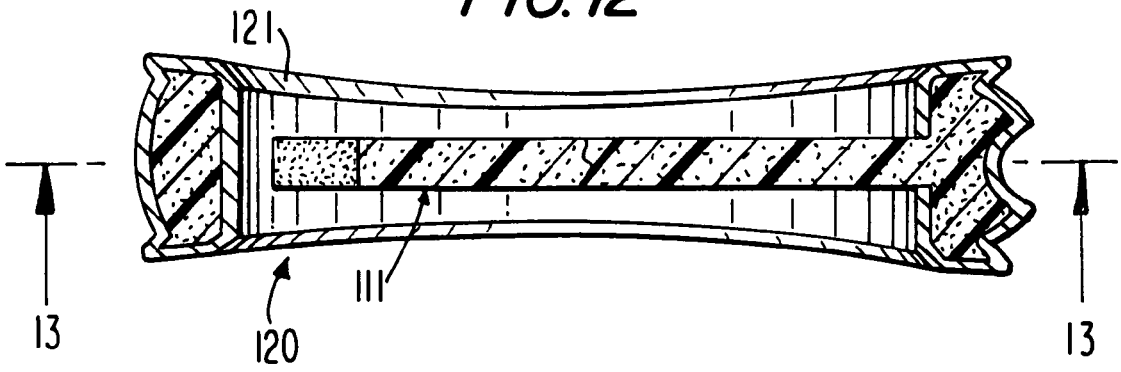
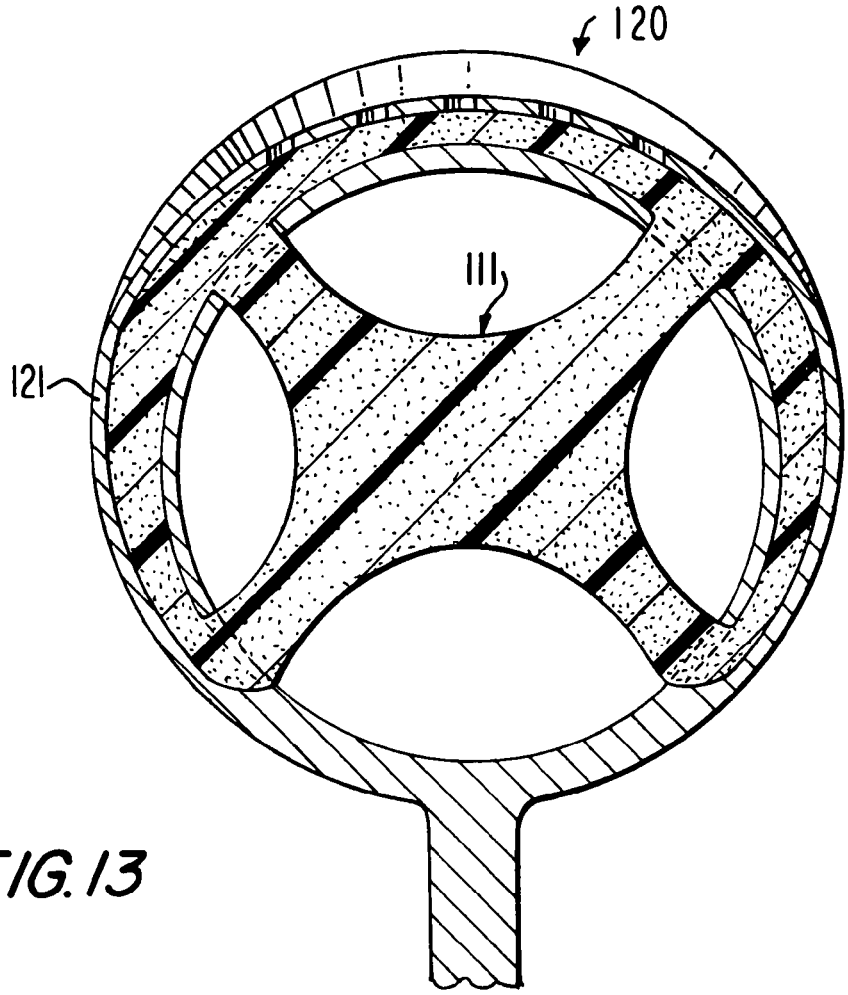
FIG. 13

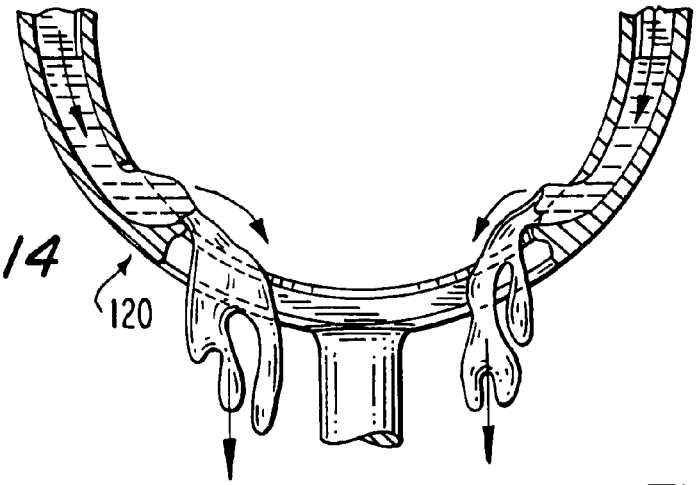
FIG.14
FIG.16
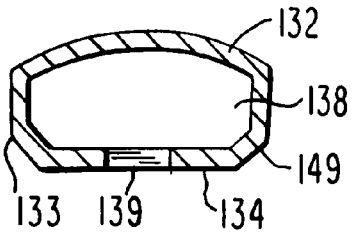
FIG.15
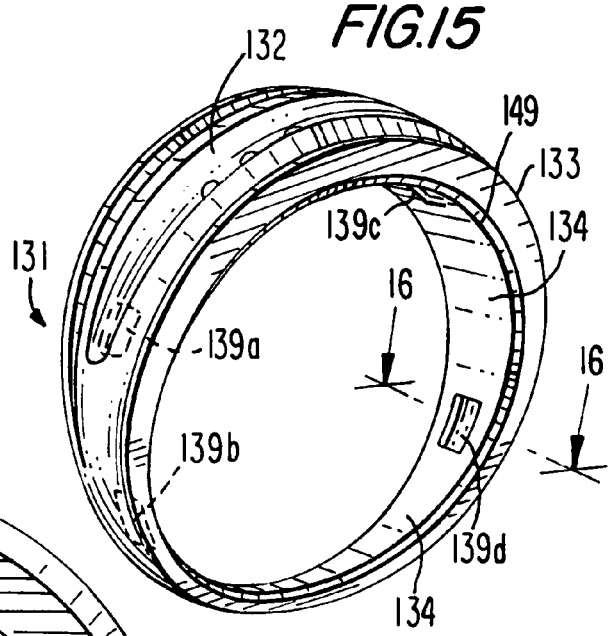
FIG.17
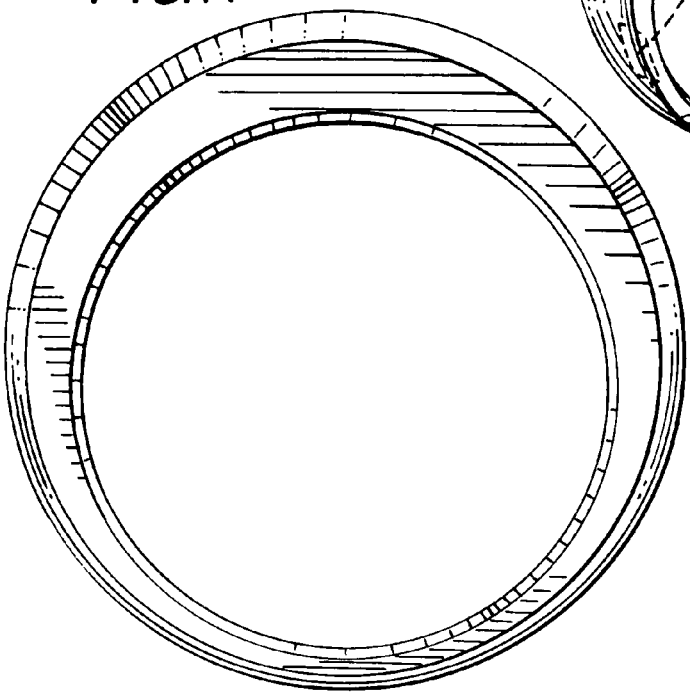
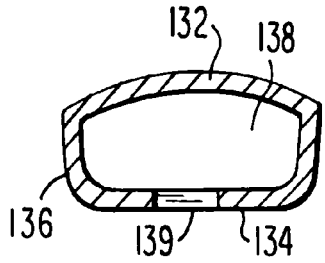
FIG.18

HOLLOW METAL JEWELRY RING

BACKGROUND OF THE INVENTION

This invention relates to a method for casting or molding an article of jewelry, and more particularly, to a method for producing a bored out or hollow jewelry article such as a ring.

There are many well known processes used in the large volume production of jewelry. Such processes include die striking, casting and electroforming, all of which are used for producing metallic jewelry articles. Such production methods are capable of facilitating high volume, high speed production with very good reproducibility. For example, using permanent-mold casting or injection molding techniques, a single mold cavity may be used repeatedly to produce, at a low cost, a virtually unlimited number of jewelry articles of intricate detail and varying size.

In order to reduce production costs in the manufacture of jewelry articles, previous improvements have generally focused upon better equipment; very little effort has been directed to actually modifying the jewelry article that is produced in order to reduce the cost thereof. One way, of course, of reducing production costs is to reduce the amount of precious or semi-precious metal that is used in producing a jewelry article, while still achieving the visual presentation that is desired by the jewelry designer.

One such prior method involves the use of an acid or water-soluble wax insert disposed in a mold cavity in order to form a mold of a partially or completely hollow article. According to this technique, a soluble wax core insert is placed in a mold cavity. Then a molten wax is injected into the mold cavity, filling the cavity and surrounding the core insert. The core insert is then removed in order to produce a wax article having a hollow core.

In the prior art, the use of soluble wax core inserts has been less than desirable. In the first place, there have been difficulties in achieving proper alignment of the insert and in preventing random movement or shifting of the insert during waxing or casting. In addition, the prior art has failed to teach the use of a soluble wax core insert such that a hollow or bored out space is defined within the ring which extends virtually along the entire arcuate length thereof.

Moreover, in the prior art U.S. Pat. No. 5,718,278 to Baum, it is stated that it is not possible to produce a ring having an inner round radius design utilizing a vertically oriented mold configuration. However, the Baum process which utilizes a horizontally oriented mold configuration is less than desirable since it is not able to produce a ring which is hollowed or bored out to an arcuate content of 200° and up to or approaching 360°.

In the prior art patents to Hashimian et al, U.S. Pat. Nos. 6,453,699 and 6,554,052 there is taught a method for fabricating a hollow jewelry article which is bored out to an arcuate extent of 200° or greater.

SUMMARY OF THE INVENTION

Generally speaking, in accordance with the invention, there is provided a method or process for fabricating a hollow jewelry article which is hollowed or bored out. In accordance with this process, a metal ring model is prepared comprising a solid shank and a metal plate supported along the internal perimeter of the shank having a plurality of spokes extending to the shank. A first metal mold is produced from the metal ring model having the external shape of the jewelry article to be manufactured. From this mold, a wax model of the jewelry article is produced which is first filed down and then cast in order to form a metal model of a core insert; the core insert, like the ring model, has a plate disposed along the perimeter of the shank and a plurality of extending spokes. This core insert is used to produce a second metal mold. This second mold may then be used repeatedly in order to form a soluble wax core insert model which is then inserted into the cavity of the first mold in order to define the hollow region of the article. A non-soluble wax is then introduced into the first mold for completely surrounding the soluble wax core insert. The non-soluble wax then hardens and the entire unit is removed from the first mold, including the soluble wax core. The core is then removed by a suitable water soluble or chemical mechanism. The remaining wax model contains a hollow core running along a substantial portion of the arcuate length thereof. The wax model is then cast in order to form the inventive ring design.

Because the ring model includes a plate with extending spokes supported along the internal perimeter of the shank, it is possible to produce a core insert of a similar configuration, thereby enabling the production of a ring or other jewelry article which is bored out or hollowed within the shank thereof.

It is therefore an object of the invention to produce a ring design having a shank which is hollowed.

Another object is to produce a ring design which uses less metal but still exhibits the same physical appearance.

Yet a further object of the invention is to produce a ring design in which the inside surface of the shank is substantially flat with rounded or beveled edges.

Still other objects and advantages of the invention will in part be obvious and will in part be apparent from the specification.

The invention accordingly comprises the several steps and the relation of one or more of such steps with respect to each of the others thereof, as well as an article of manufacture produced by carrying out these steps, and which possesses the features, properties and relation of elements, all of which will be exemplified in the process and article hereinafter disclosed and described, and the scope of the invention will be indicated in the claims.

DESCRIPTION OF THE DRAWINGS

For a fuller understanding of the invention, reference is made to the following description taken in connection with the accompanying drawings, in which:

FIG. 10 is a cross-sectional view taken along line 10-10 of FIG. 9;

FIG. 11 is a cross-sectional view of the final plastic wax model that is produced utilizing the ring mold depicted in FIGS. 7-9 and showing both the soluble and non-soluble components thereof;

FIG. 12 is a cross-sectional view taken along line 12-12 of FIG. 11;

FIG. 13 is a cross-sectional view taken along line 13-13 of FIG. 11;

FIG. 14 is a partial cross-sectional view of the final plastic wax model showing the soluble component dripping out;

FIG. 15 is a perspective view of a finished ring made by casting the non-soluble portion of the final plastic wax model;

FIG. 16 is a cross-sectional view taken along line 16-16 of FIG. 15;

FIG. 17 is a perspective view of an alternative version of a finished ring made in accordance with the invention;

FIG. 18 is a cross-sectional view taken along line 18-18 of FIG. 17;

DETAILED DESCRIPTION OF THE PREFERRED EMBODIMENT

Figure 1:
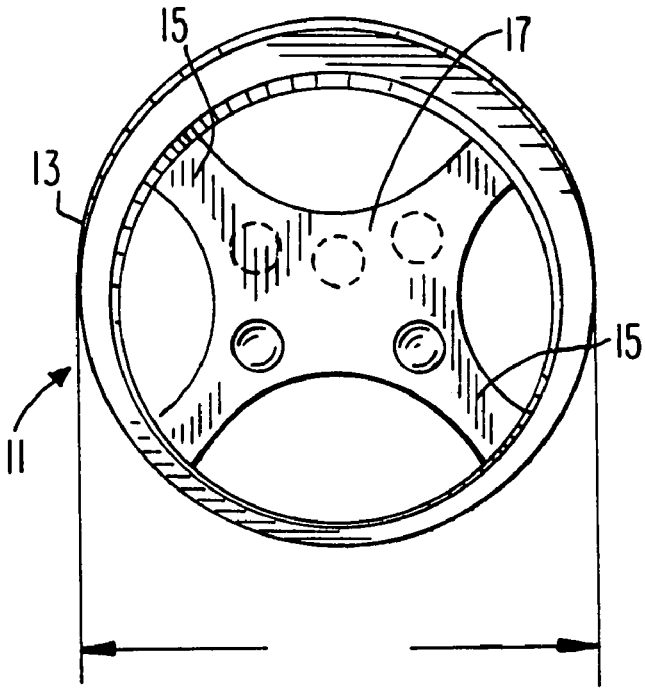
FIG. 1 is a front elevational view of a metal ring model and inside supporting plate that is used to produce the inventive jewelry ring.
Figure 3:
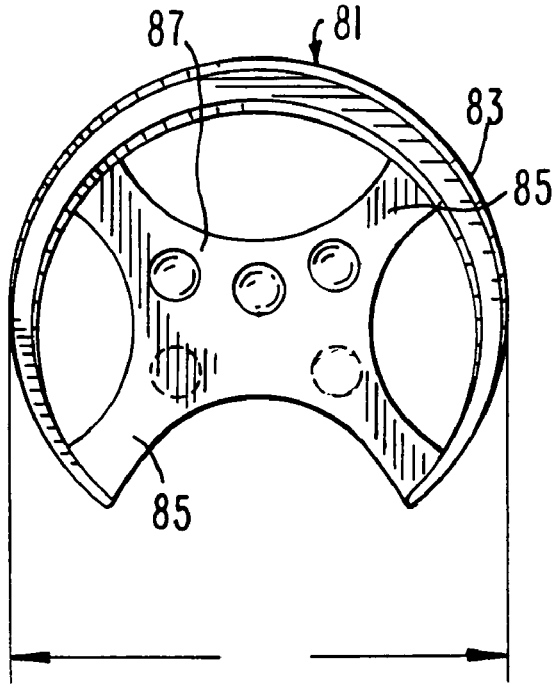
FIG. 3 is a front elevational view of a metal model of the core insert.

Referring first to FIG. 1, a metal ring model which is used in producing a ring mold is generally indicated at 11. Metal ring model 11 consists of a shank 13, an internally extending plate element 17 supported along the internal perimeter of shank 13 and a plurality of extending fingers or spokes 15. Metal ring model 11 has an external shape identical to the jewelry ring that is to be produced in accordance with the invention. Shank 11 has a flat finger facing surface with rounded or beveled edges. Metal plate 17, including fingers 15, are provided for enabling production of a core insert with a supporting plate and for thereby defining the extent to which the shank of the ring to be produced is hollowed or bored out, as described. Metal ring model 11 is used, as is well known in the art, to then prepare a vertically oriented mold thereof, as shown in FIG. 2.

Figure 2:
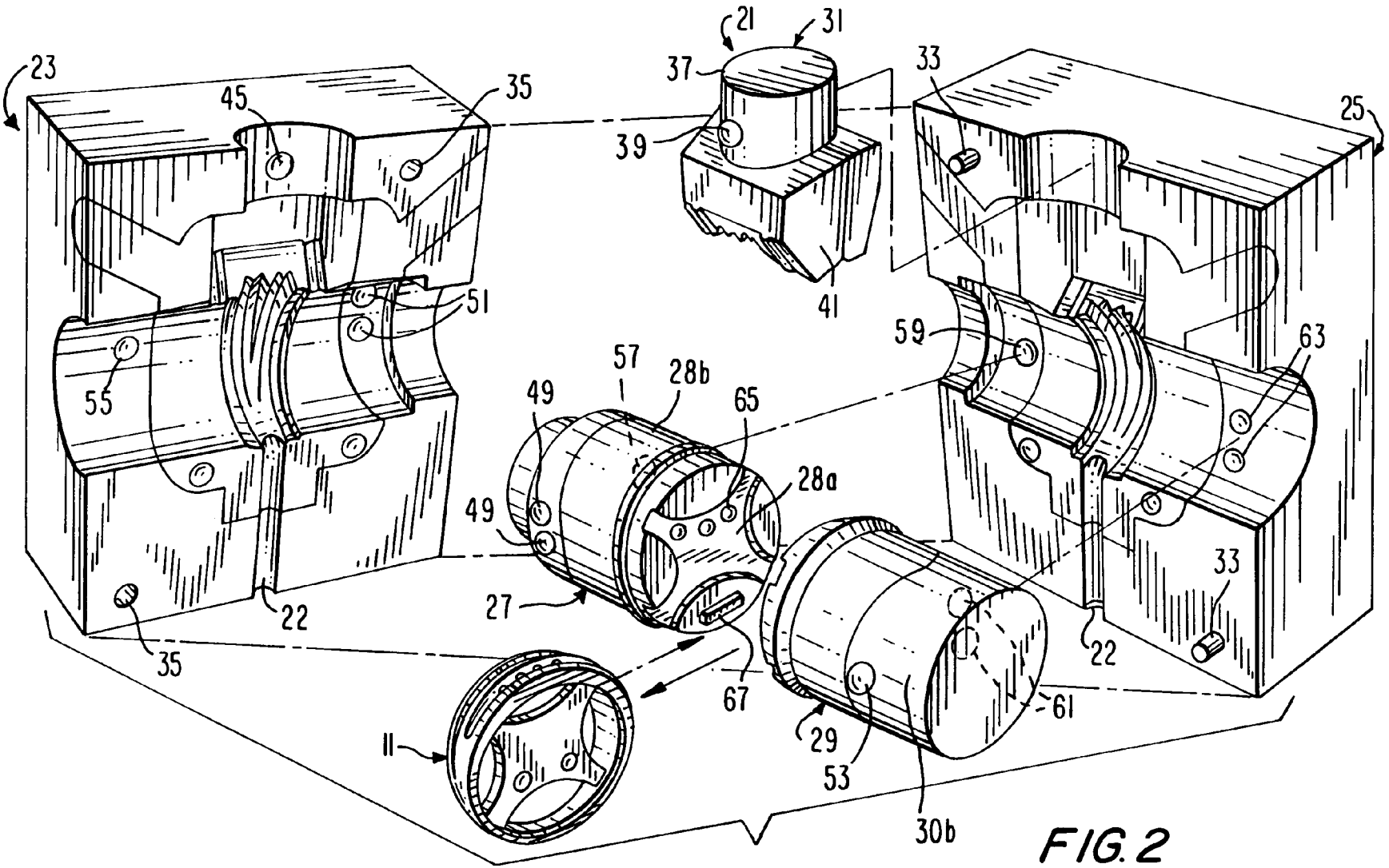
FIG. 2 is an exploded perspective view of two die elements, first and second side mold inserts and a crown mold insert, which together define a ring mold used in accordance with the present invention.
Figure 4:
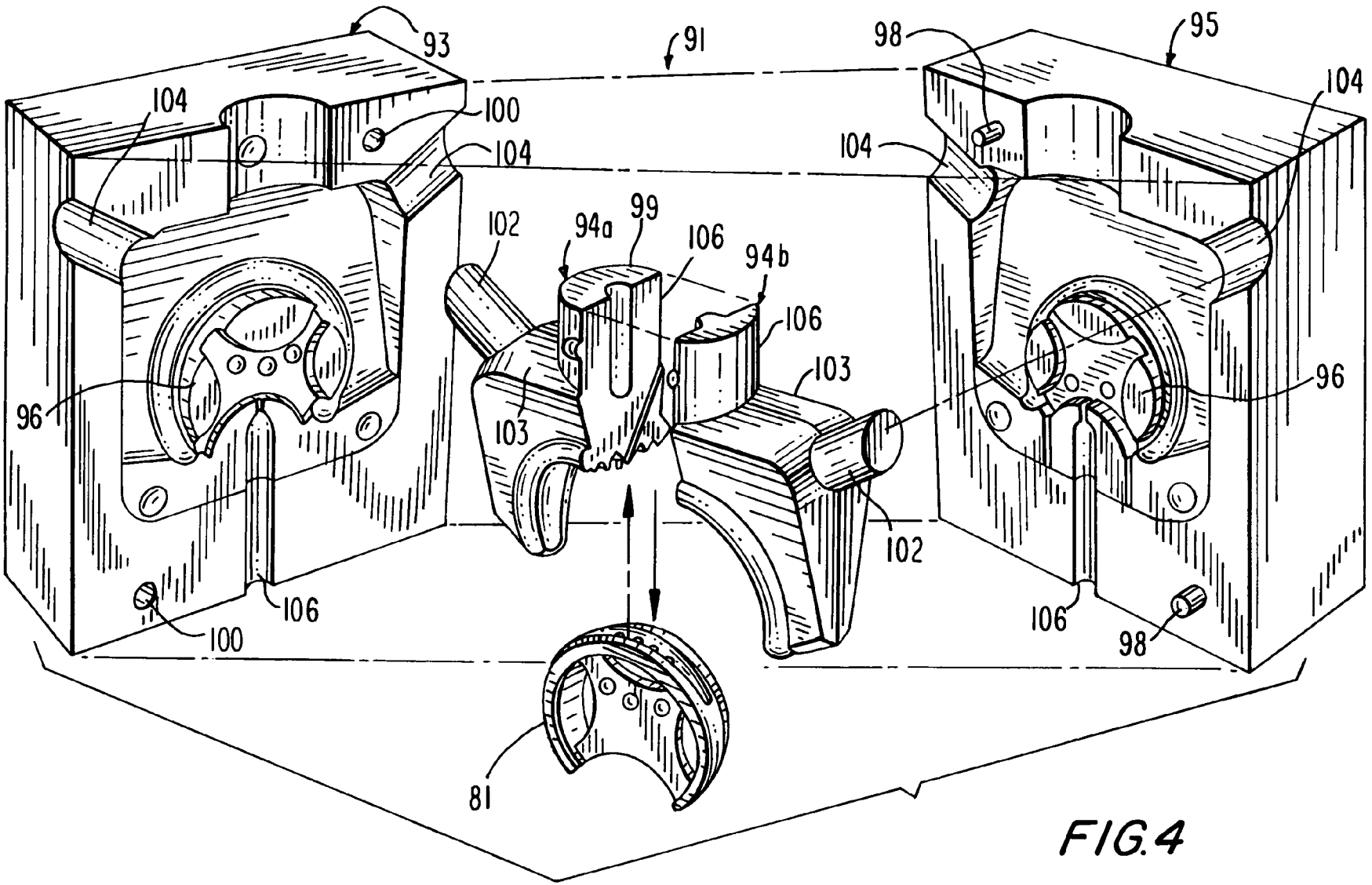
FIG. 4 is a an exploded perspective view of the two die elements of a second mold that is used to produce a wax model of the core insert.

Referring now to FIG. 2, a metal ring mold produced from metal ring model 11 depicted in FIG. 1 is generally indicated at 21. Ring mold 21 is vertically oriented and includes a pair of metal die elements 23 and 25, a pair of metal split side mold inserts 27 and 29, and a metal crown mold insert 31 in order to define, when assembled, a cavity that is shaped like metal ring model 11.

To facilitate proper alignment and assembly of die elements 23 and 25, locator pins 33 are provided along die element 25 for fitting into corresponding locator holes 35 formed along die element 23. Die elements 23 and 25 also define an inlet port 22 of mold 11 for injecting wax thereinto, as later described.

As shown in FIG. 2, crown mold insert 31 has a head portion 37 and a shoulder portion 41. Head portion 37 has a locator plug 39 which is sized to be receivingly engaged within locator hole 45 of die element 23 in order to properly align crown mold insert 31 inside of mold 21.

Each of side inserts 27 and 29 are cylindrically shaped and include inwardly directed top surfaces 28A and outside radial surfaces 28B and 30B. Top inside surface 28A of side insert 27 is formed with locator buttons 65 and a locator foot 67 for selectively and cooperatively engaging the top inside surface of side insert 29. Because of their design, side inserts 27 and 29, when mated together, define a space or cavity 26 (see FIG. 8) of a configuration that is shaped like that of metal ring model 11. Radial surfaces 28B and 30B of mold inserts 27 and 29 are also formed with protuberances 49, 57 (for insert 27) and 53, 61 (for insert 29). These protuberances are selectively received in holes 51, 55 (of die element 23) and 59, 63 (of die element 25) in order to cooperatively retain inserts 27 and 29 in proper position within mold 21.

Figure 5:
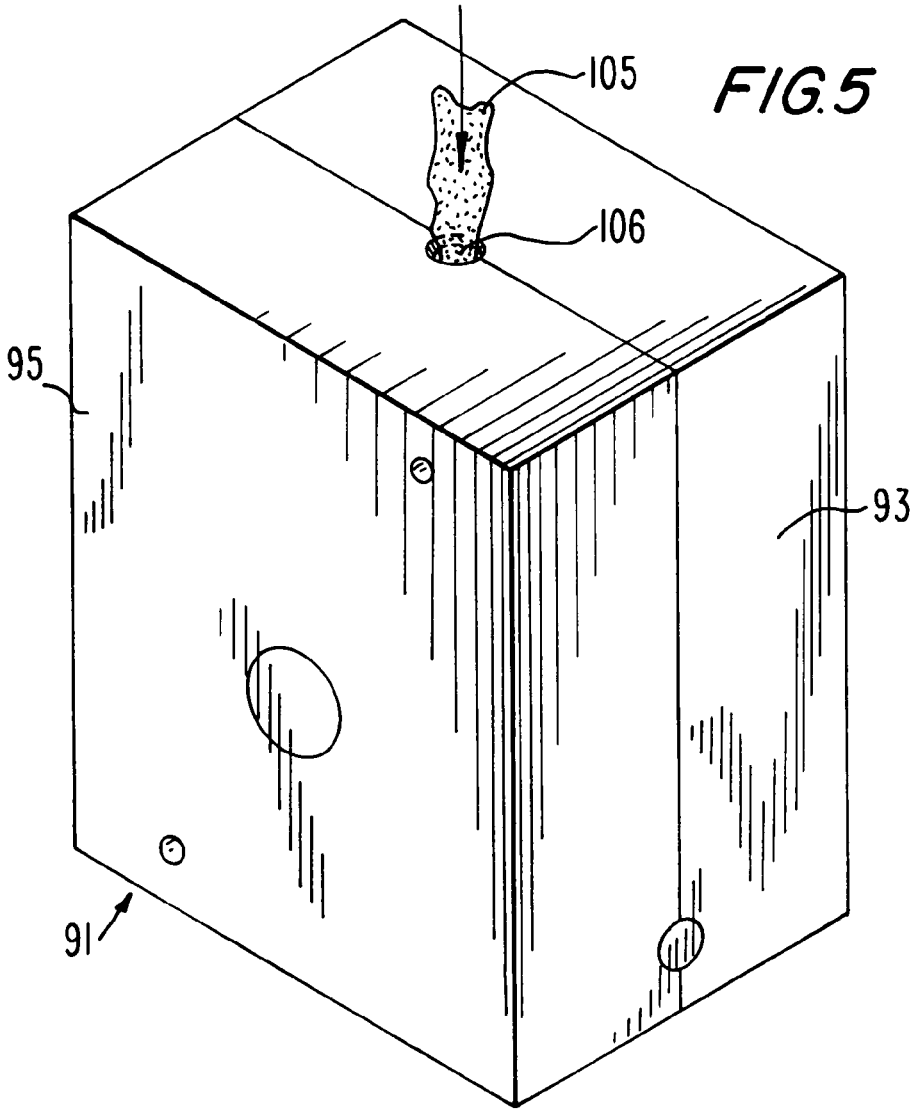
FIG. 5 is a bottom perspective view of the core insert mold depicted in FIG. 6 in assembled condition.
Figure 6:
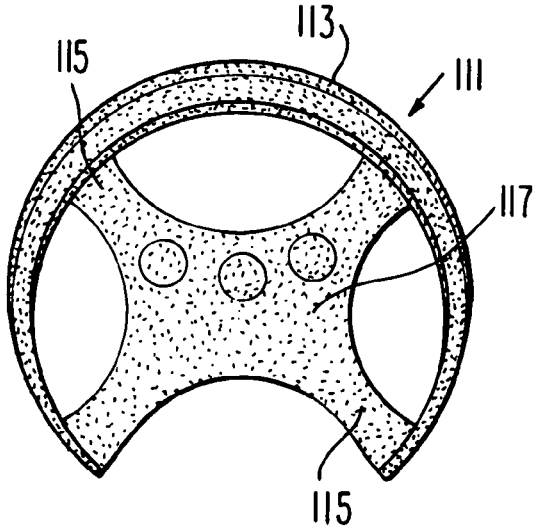
FIG. 6 is a front elevational view of a soluble wax model of the core insert that was produced utilizing the mold depicted in FIGS. 4 and 5.

Once mold 21 is fully assembled, wax is injected therein through inlet port 22 in order to produce a wax model of the ring. The wax model is filed down, after which it is cast in order to produce a metal core insert model 81, as depicted in FIG. 5. Metal core insert model 81, like metal ring model 11 depicted in FIG. 1, includes a shank 83, a plate element 87 supported along the internal perimeter of shank 83 and a plurality of extending fingers or spokes 85. Significantly, metal core insert model 81 has a slightly smaller but nonetheless identical external shape to that of metal ring model 11. From metal insert model 81, using processes well known to one of ordinary skill in the art, a metal core insert mold, generally indicated at 91 and shown in FIGS. 6 and 7, is produced.

Core insert mold 91, used to form a core insert, as described below, is of a somewhat similar construction to that of ring mold 11 and includes a first metal die element 93, a second metal die element 95, and a pair of side mold inserts 94A and 94B, which together, when assembled, define a core cavity 96. Die element 95 includes a pair of locator pins 98 which are designed to be matingly engaged with locator holes 100, as indicated in FIG. 6, in order to place mold 91 in a desired closed assembled condition, as shown in FIG. 5. Mold inserts 94A and 94B each include head portion 106 and shoulders 103, an extending plug 102, the latter of which are received in slots 104 formed along die elements 93 and 95, in part to provide separation between die elements 93 and 95 and thus define cavity 96. Mold 91 is also provided with an inlet port 106 for injection of soluble wax into mold 91 (See FIG. 5) in order to form a soluble wax model 111 of the core insert, as shown at 111 in FIG. 6.

Core insert wax model 111 is produced following injection of soluble wax or other suitable soluble material through port 106 and into core insert mold 91 (FIG. 5). As can be appreciated, soluble wax model 111 has the same shape, but is slightly smaller than, the shape of ring wax model 71. Core insert wax model 111 includes a shank 113, and an insert element 117 supported along the internal perimeter of shank 113 and a plurality of extending fingers or spokes 115.

Figure 7:
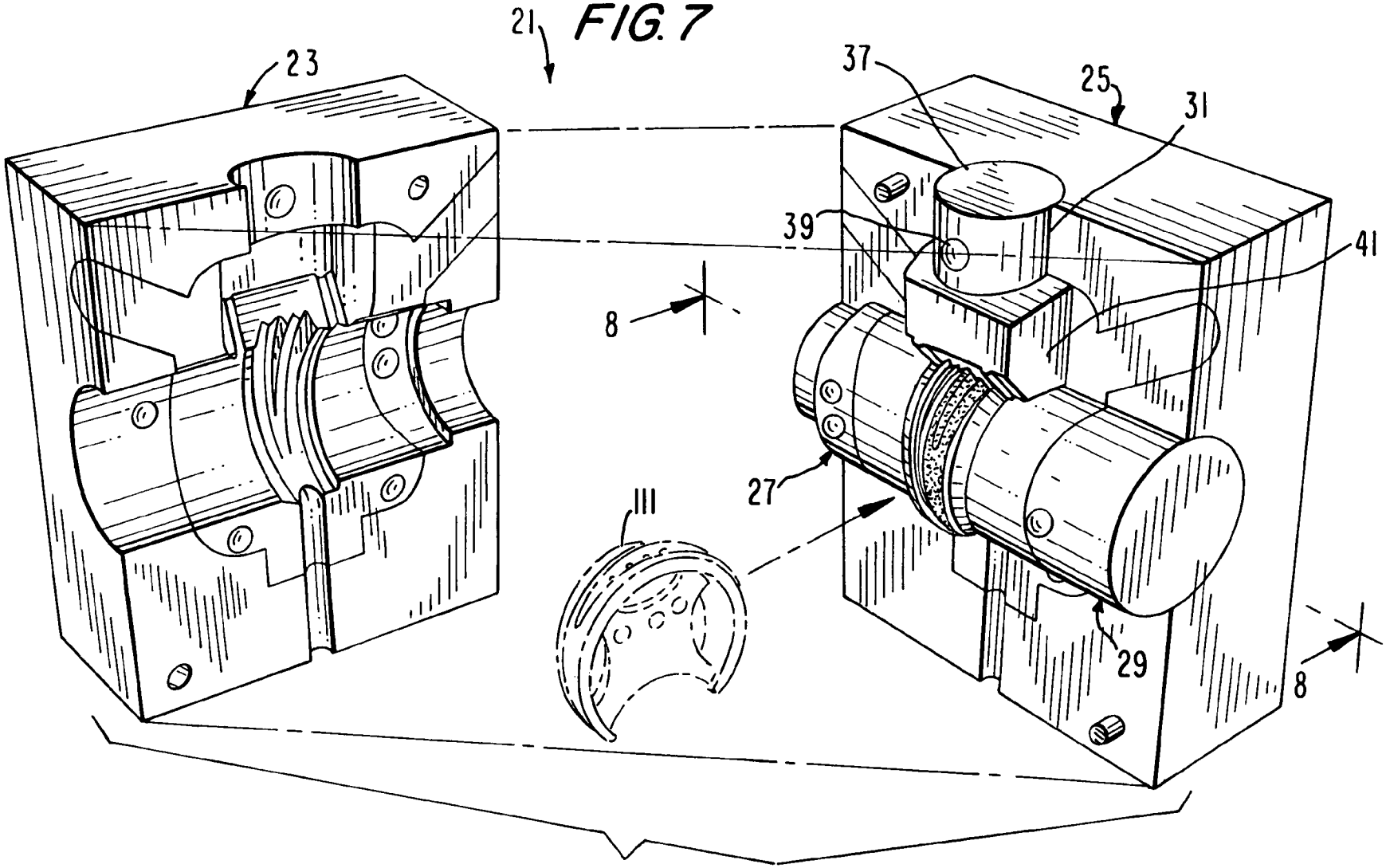
FIG. 7 is a partially exploded perspective view of the ring mold depicted in FIG. 2 in partially assembled condition with the soluble wax model of the core insert to be disposed between the two side mold inserts.
Figure 9:
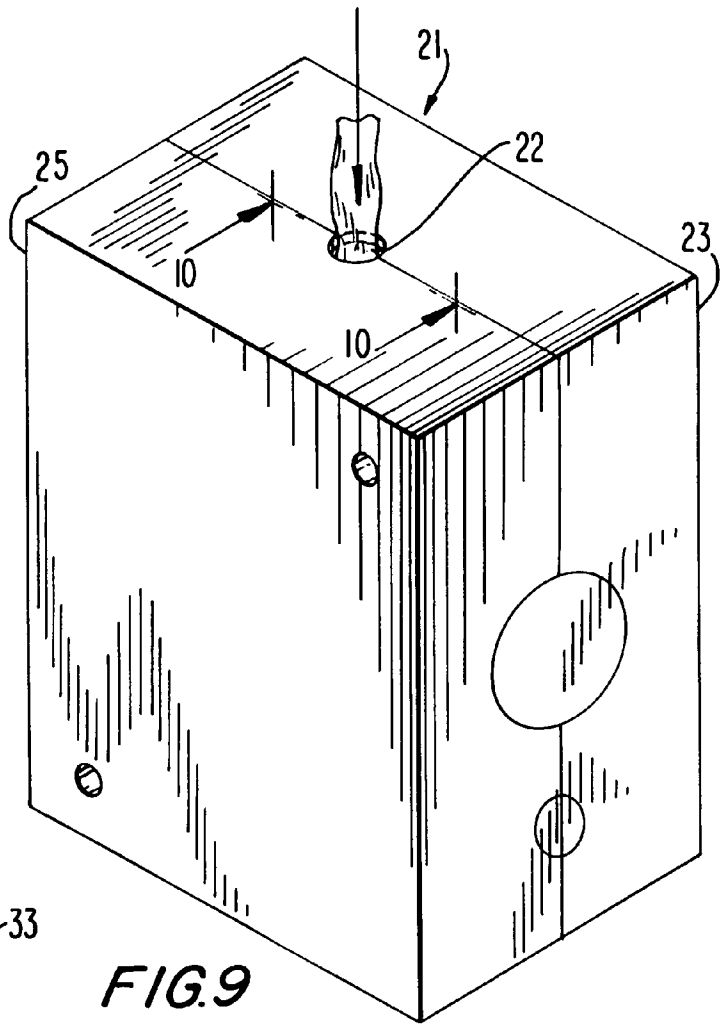
FIG. 9 is a perspective view of the ring mold in assembled condition.
Figure 8:
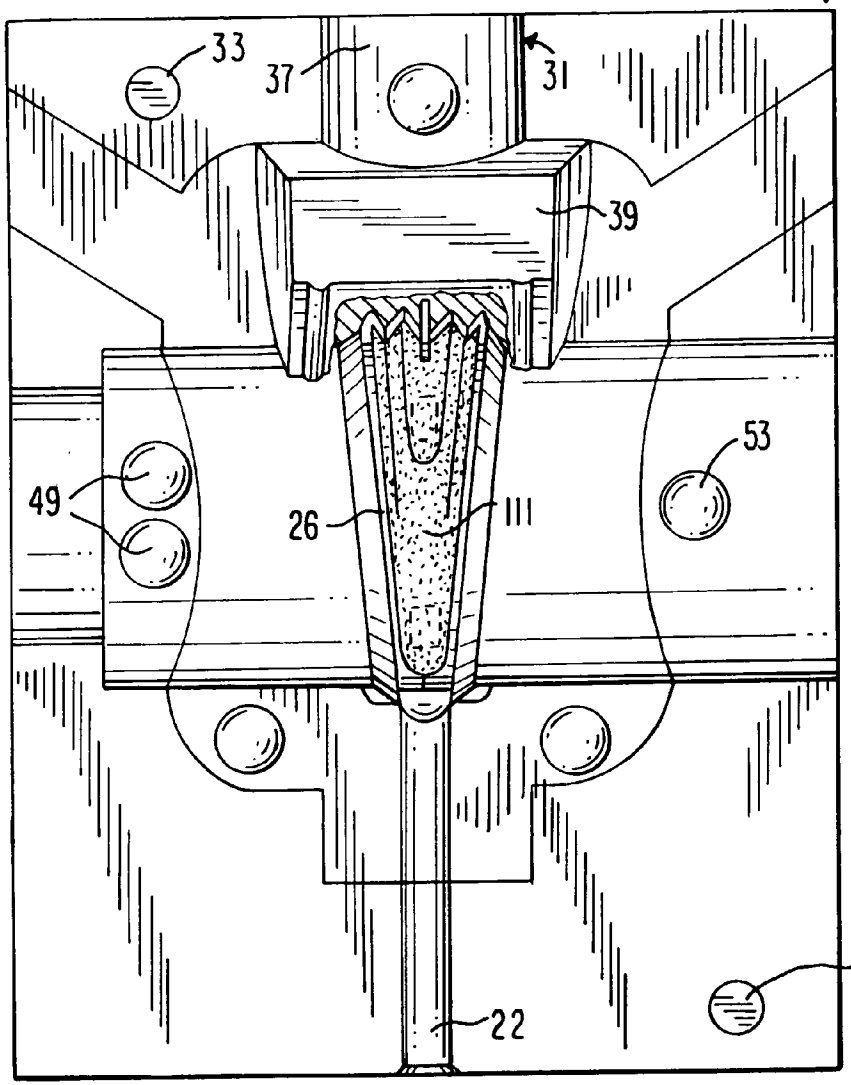
FIG. 8 is a front elevational view of one of the die elements of the ring mold and showing the soluble wax model of the core insert disposed between the two side mold inserts of the mold.

To fabricate the inventive ring extending fingers 115, core insert wax model 111 is placed inside ring mold 21, as shown in FIGS. 7 and 8, and positioned between first and second side mold inserts 27 and 29 and under crown mold insert 31. Because core insert wax model 111 is somewhat smaller in size than the ring to be produced, a gap is defined in cavity 26 and between first and second side mold inserts 27 and 29 and below crown mold insert 31 (see FIG. 9A). This gap defines the thickness of the shank wall of the final ring product, as discussed later. This gap is adjustable in size depending upon the extent to which the ring wax model is filed down when producing metal core insert model 81, as discussed before.

Once core insert wax model 111 is precisely positioned within ring mold 21, mold 21 is closed and a molten wax is introduced through port 22 and into ring mold 21 (see FIG. 9), thereby filling the mold cavity and completely surrounding core insert wax model 111. After hardening, a wax article 120 (see FIGS. 11-13) is produced and then removed from mold cavity 26 in ring mold 21 with core insert wax model 111 intact. Wax model 111 is then eliminated from article 120 (see FIG. 14) by applying a water soluble or another chemical mechanism, as is well known in the art, thereby leaving behind a non-soluble wax replica or component 121 of the inventive ring. FIGS. 11-13 illustrate both the non-soluble 121 and soluble 111 components which make up plastic article 120 that is produced at this stage in the process.

Non-soluble component 121 is used to produce a cast metal ring generally indicated at 131 in FIGS. 15 and 16. This is achieved by one of many well known methods known to those of skill in the art, such as the lost wax investment casting method. As can be appreciated, the final finished ring, as indicated at 131, includes a shank 133 having an outer groove 132.

Ring 131 is formed with upper openings 139*a* and 139*c* and lower openings 139*b* and 139*c* along finger facing surface 134 of shank 133 leading to an internal running hollow cavity 138 (see FIG. 16). The arcuate range between openings 139*a* and 139*b*, as well as between openings 139*c* and 139*d*, extends between about 60° and 90° along shank 133. The arcuate range between openings 139*a* and 139*c* extends between about 90° and 120° along shank 133. The arcuate range between openings 139*b* and 139*d* extends between about 60° and 120° along shank 133.

Cavity 138 arcuately extends between 240° and 300° along shank 133. In this embodiment, finger facing surface 134 is flat with beveled edges 149. Significantly, in order to enhance comfort when wearing ring 131, shank 133 (see FIGS. 17 and 18) has finger facing surface 134 being flat with slightly rounded edges 136.

Importantly, wall 132 of shank 133 has a thickness of between 0.017 and 0.030 inch. The preferred thickness of wall 132 is 0.020-0.22 inch.

In accordance with the invention, each opening of ring 131 produced under the current invention has an arcuate range of between about 15° to 30° and are three-five in number.

Figure 19:
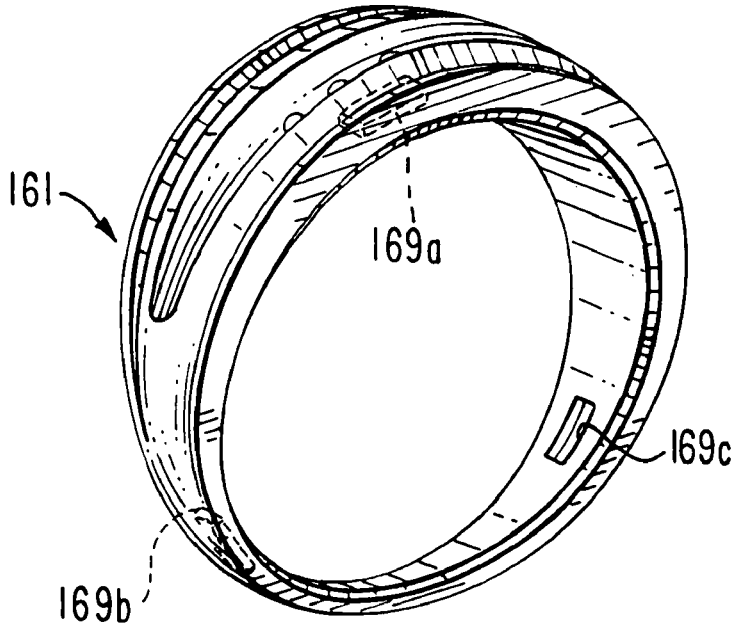
FIG. 19 is a perspective view of an alternate embodiment of a finished ring made by the inventive process.

In the three opening version of the inventive ring, as shown in FIG. 19 at 161, there is a single upper central opening 169*a* and two lower openings 169*b* and 169*c*. The arcuate distance between opening 169*a* and 169*b*, as well as between 169*a* and 169*c*, extends between about 120° and 145° along the shank. The arcuate distance between openings 169*b* and 169*c* extends between about 60° and 120° along the shank.

Figure 20:
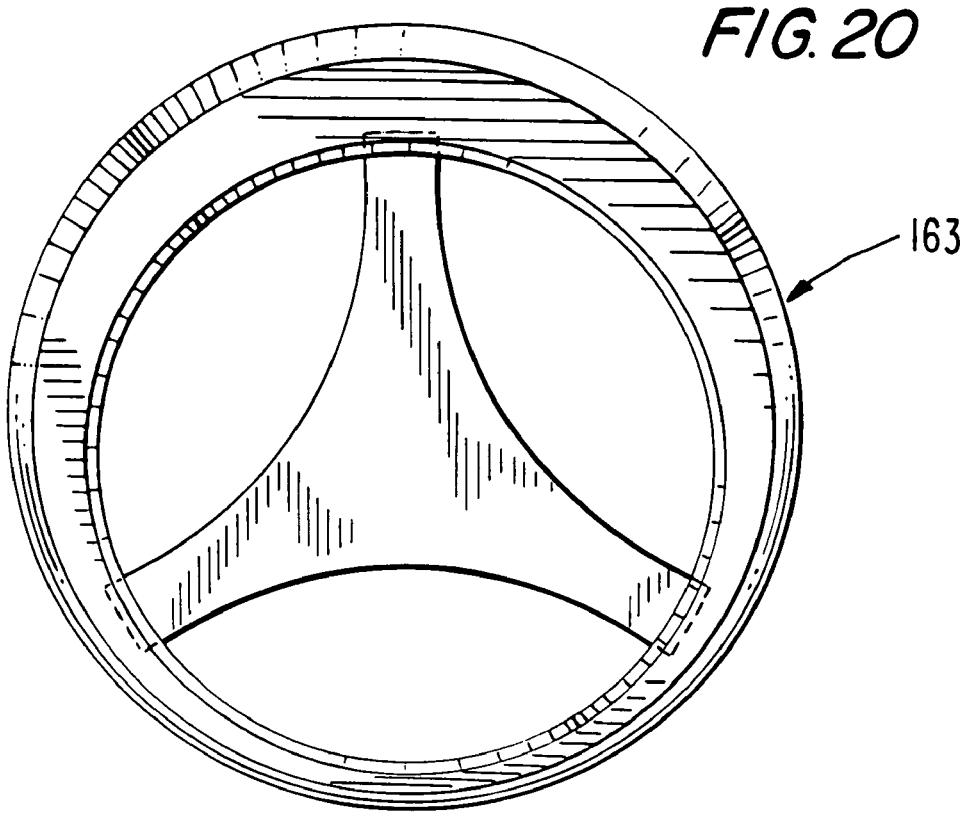
FIG. 20 is a front elevational view of a metallic ring model used to produce the ring shown in FIG. 19.

Ring 161 shown in FIG. 19 is produced by starting with a metal ring model 163 (See FIG. 20) in the same manner as described with respect to ring 131 (See FIG. 15).

Figure 21:
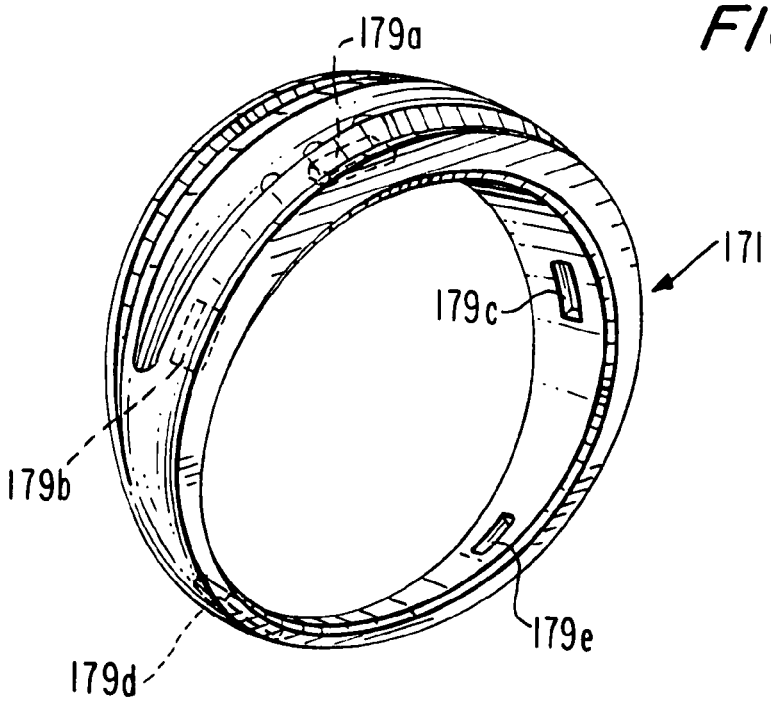
FIG. 21 is a perspective view of a further embodiment of a finished ring made by the inventive process.
Figure 22:
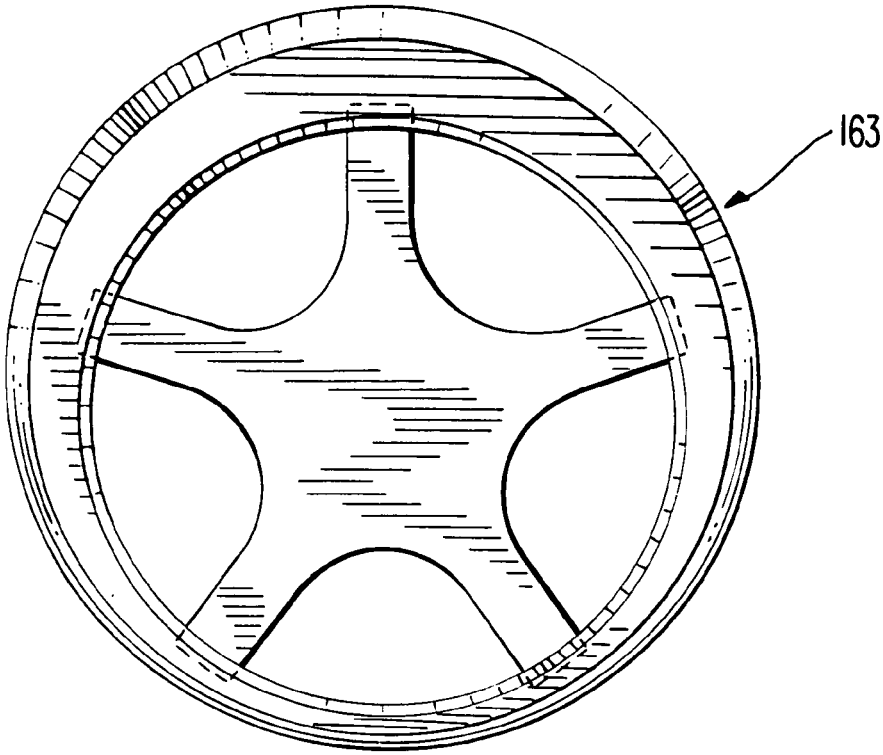
FIG. 22 is a front elevational view of a metal ring model used to produce the ring shown in FIG. 21.

In the five opening version of the inventive ring, as shown in FIG. 21 at 171, there is a single upper central opening 179*a*, two side openings 179*b* and 179*c*, and two lower openings 179*d* and 179*e*. The arcuate distance between upper central opening 179*a* and each side opening extends between about 60° and 90° along the shank. The arcuate distance between side opening 179*b* and lower opening 179*d*, and between opening 179*c* and 179*e*, extends between about 30° and 60° along the shank. The distance between the two lower openings extends between about 60° and 120° along the shank. Ring 171 shown in FIG. 21 is produced by starting with a metal ring model 173 (see FIG. 22) in the same manner as described with respect to ring 131 (FIG. 15).

It will thus be seen that the objects set forth above, among those made apparent from the preceding description, are efficiently attained by practicing the invention and it is also understood the invention includes any and all changes or modifications thereto which would be apparent to one of ordinary skill in the art and which come within the spirit and scope of the inventive concept.

The invention claimed is:

1. A metal jewelry ring formed by casting comprising a shank having a hollow cavity which arcuately extends between about 240° and 360° therealong, the shank having a finger facing surface with rounded edges, the finger facing surface having a plurality of openings leading into said hollow cavity;

wherein along any cross-section in a longitudinal direction said finger facing surface of said shank is substantially straight.

2. The ring of claim 1, wherein each of said plurality of openings arcuately extends between about 15° and 30° along said shank.

3. The ring of claim 1, wherein said shank is defined by a wall having a thickness of between about 0.017 and 0.030 inch.

4. The ring of claim 3, wherein said wall has a thickness of between about 0.020 and 0.022 inch.

5. The ring of claim 1, wherein said plurality of openings are between three and five in number.

6. The ring of claim 1, wherein said plurality of openings are not all equally spaced one from the other.

7. A metal jewelry ring formed by casting comprising a shank having a hollow cavity which arcuately extends between 240° and 360° therealong, the shank having a finger facing surface with beveled edges, the finger facing surface having a plurality of openings leading into said hollow cavity, wherein along any cross-section in a longitudinal direction said finger facing surface of said shank is substantially straight.

8. The ring of claim 7, wherein each of said plurality of openings arcuately extends between about 15° and 30° along said shank.

9. The ring of claim 7, wherein said shank is defined by a wall having a thickness of between about 0.017 and 0.030 inch.

10. The ring of claim 9, wherein said wall has a thickness of between about 0.020 and 0.022 inch.

11. The ring of claim 7, wherein said plurality of openings are between three and five in number.

12. The ring of claim 7, wherein said plurality of openings are not all equally spaced one from the other.

* * * * *